US005892531A

United States Patent [19]

Mistyurik et al.

[11] Patent Number: 5,892,531

[45] **Date of Patent: *Apr. 6, 1999**

[54] PRINTER

[75] Inventors: John D. Mistyurik, Troy; Mark W. Roth, Miamisburg; James R. Small, Beavercreek, all of Ohio

[73] Assignee: Monarch Marking Systems, Inc., Dayton, Ohio

[ * ] Notice: The term of this patent shall not extend beyond the expiration date of Pat. No. 5,570,121.

[21] Appl. No.: 727,723

[22] Filed: Oct. 7, 1996

Related U.S. Application Data

[62] Division of Ser. No. 169,899, Dec. 20, 1993, Pat. No. 5,570,121.

[51] Int. Cl.[6] ..... B41J 25/304; B41J 25/308

[52] U.S. Cl. ..... 347/222; 347/197; 347/198

[58] Field of Search ..... 347/222, 197, 347/198; 400/120.17, 120.16; 156/384, 277, 541

[56] References Cited

U.S. PATENT DOCUMENTS

| | | | |
|---|---|---|---|
| 3,955,711 | 5/1976 | Schroter . | |
| 4,407,692 | 10/1983 | Torbeck . | |
| 4,776,714 | 10/1988 | Sugihara et al. | 400/248 |
| 4,956,045 | 9/1990 | Goodwin et al. | 156/384 |
| 4,957,379 | 9/1990 | Hamisch, Jr. et al. | 100/288 |
| 5,267,800 | 12/1993 | Petteruti et al. . | |
| 5,336,003 | 8/1994 | Nagashima et al. | 400/708 |
| 5,401,352 | 3/1995 | Matsushita et al. . | |
| 5,570,121 | 10/1996 | Mistyurik et al. | 347/171 |

FOREIGN PATENT DOCUMENTS 0449236 10/1991 European Pat. Off. .

*Primary Examiner*—Huan Tran
*Attorney, Agent, or Firm*—Joseph J. Grass

[57] ABSTRACT

There is disclosed a thermal printer having a print head and a pressure roller cooperable with a platen roll, with one manually operable member for substantially simultaneously separating the print head and the pressure roll for threading the printer and another member for separating the print head widely from the platen roll for cleaning purposes.

20 Claims, 4 Drawing Sheets

PRINTER

CROSS-REFERENCE TO RELATED APPLICATION

This is a division of application Ser. No. 08/169,899, filed Dec. 20, 1993, now U.S. Pat. No. 5,570,121, granted Oct. 29, 1996.

BACKGROUND OF THE INVENTION

1. Field of the Invention

This invention relates to the printing art.

2. Brief Description of the Prior Art

The following patents are made of record: U.S. Pat. Nos. 3,955,711; 4,407,692; 4,776,714; U.S. Pat. No. 4,956,045; U.S. Pat. Nos. 4,957,379; 5,267,800 and European patent application 0 449 236.

SUMMARY OF THE INVENTION

The invention relates to an improved, low cost, simple, easy-to-use printer.

It is a feature of the invention to provide an improved printer in which labels releasably adhered to a carrier web can be printed by a thermal print head cooperable with a platen roll at a printing position, and in which a pressure roller contacts the carrier web downstream of the printing position and urges the carrier web against the platen roll, and a slide which enables the user to separate both the print head and the pressure roller from cooperation with the platen roll. In a preferred embodiment, the pressure roller is mounted on a slide, and the print head is a part of a print head assembly. The print head assembly and the slide are urged relatively toward each other and into cooperation with the platen roll by preferably two springs.

It is another feature of the invention to provide an improved construction for a printer, wherein a platen roll is mounted on a drive shaft, the drive shaft is rotatably mounted in mounting members secured to the frame, an electric motor drives the drive shaft through gearing, and a delaminator is held captive between the mounting members and the frame.

It is another feature of the invention to provide two separate means for separating the print head and the platen roll. One of these means includes a manually operable lever for moving the print head away from the platen roll by a certain distance to facilitate threading of the printer. The other means moves the print head away from the platen by a greater distance to enable the print head to be readily cleaned.

Other features and advantages will become apparent to those skilled in the art from the following detailed description and by reference to the accompanying drawings.

DETAILED DESCRIPTION OF THE PREFERRED EMBODIMENT

Figure 1:
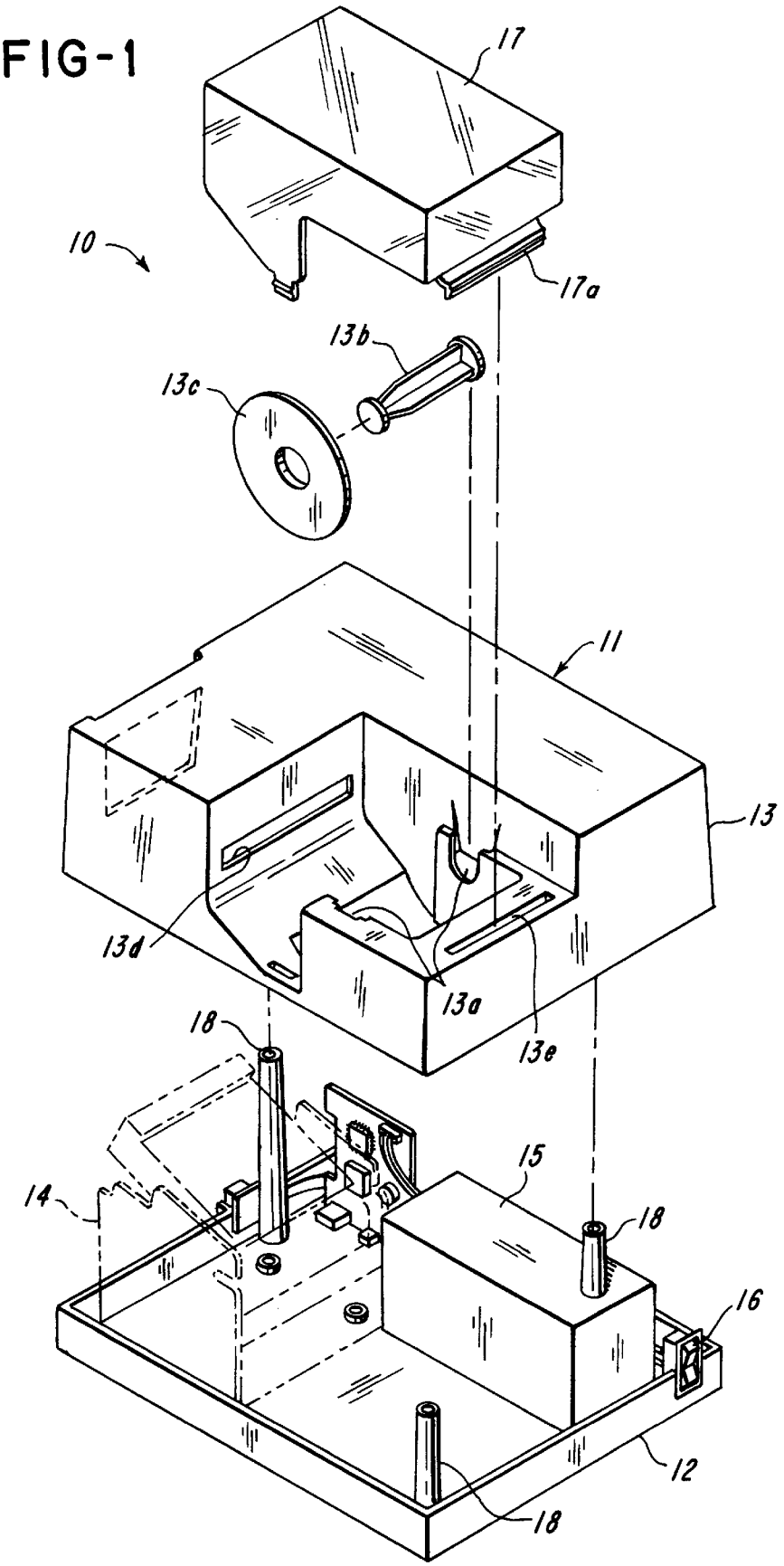
FIG. 1 is a partially exploded perspective view of the printer of the invention, with certain parts shown by phantom lines.

With reference to FIG. 1, there is shown a printer generally indicated at 10 having a housing 11 comprising a base 12 and a cover 13. The base 12 mounts a printer mechanism 14 shown in phantom lines. The base 12 includes a box-like portion 15 for housing a battery pack (not shown). An on/off switch 16 is located at the rear of the base 12. The cover 13 has a pair of opposed slots 13*a* for receiving end portions of a spindle 13*b*. A roll (not shown) of record members RM (FIG. 3) is received on the spindle 13*b*. A disc 13*c* serves as a guide for one side of the roll. The cover 13 has a slot 13*d* through which the record members RM can pass to the printer mechanism 14. A dust cover 17 having a projection 17*a* received in a slot 13*e* is pivotally mounted on the cover 13 for movement between closed and open positions. Posts 18 are used to secure the cover 13 to the base 12.

Figure 2:
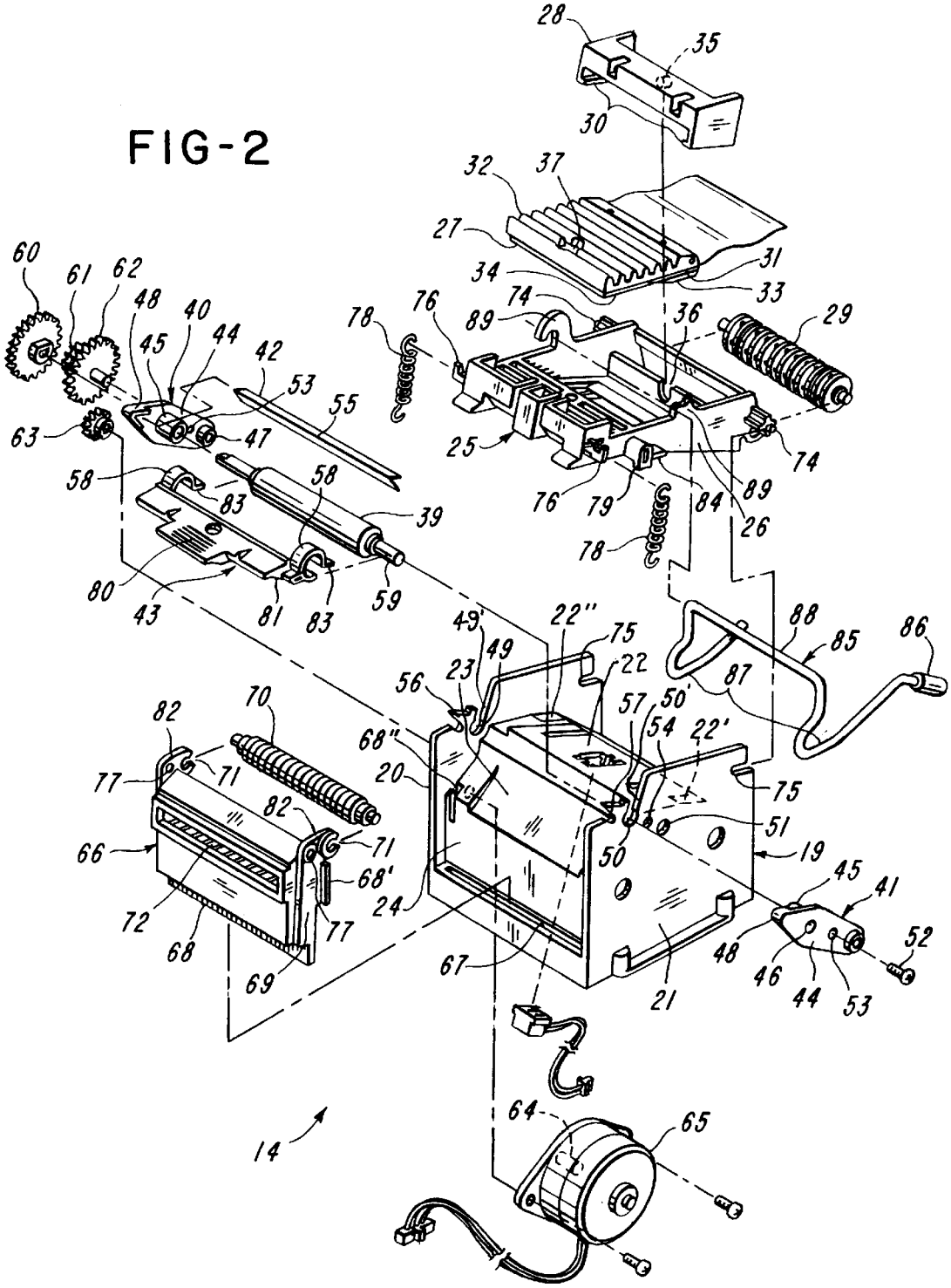
FIG. 2 is an exploded perspective view showing various components of the printer.

With reference to FIG. 2, the printer mechanism 14 is shown to include a frame 19 having end walls 20 and 21, an upper guide surface 22 joined to a front guide surface 23, and a front wall 24.

A print head assembly generally indicated at 25 includes a holder 26, a print head device 27 and its mounting member 28, and a guide roller 29. The mounting member 28 has a pair of opposed parallel ridges 30 received beneath the underside of a heat sink 32. A print head 34 is disposed on the underside of the heat sink 32. The mounting member 28 has an annular stud 35 received in a notch 36 in the holder 26. The heat sink 32 has a recess 37 for receiving a rounded projection 38 (FIG. 4) on the holder 26. There is clearance between the print head device 27 and the holder 26 so that the print head device 27 can rock or pivot slightly relative to the firmly mounted holder 26. This allows the print head 34 to accommodate to a platen roll 39. It is apparent that the projection 38 received in the recess 37 and the stud 35 received in the notch 36 enable the print head device 27 to rock or pivot.

A pair of identical mounting members 40 and 41 mount the platen roll 39, a delaminator 42 and a lever 43. Each mounting member 40 and 41 has a plate or wall 44, a tubular projection 45 aligned with a cutout 46 in the wall 44, a tubular projection 47, and an angle-shaped wall or projection 48. The projections 45 are received in respective cutouts 49 and 50 in end walls 20 and 21. The projections 47 are received in holes 51 (only one of which is shown) in end walls 20 and 21. Screws 52 (only one of which is shown) pass through respective holes 53 in plates 44 and are threadably received in holes 54 (only one of which is shown) in end walls 20 and 21.

Figure 3:
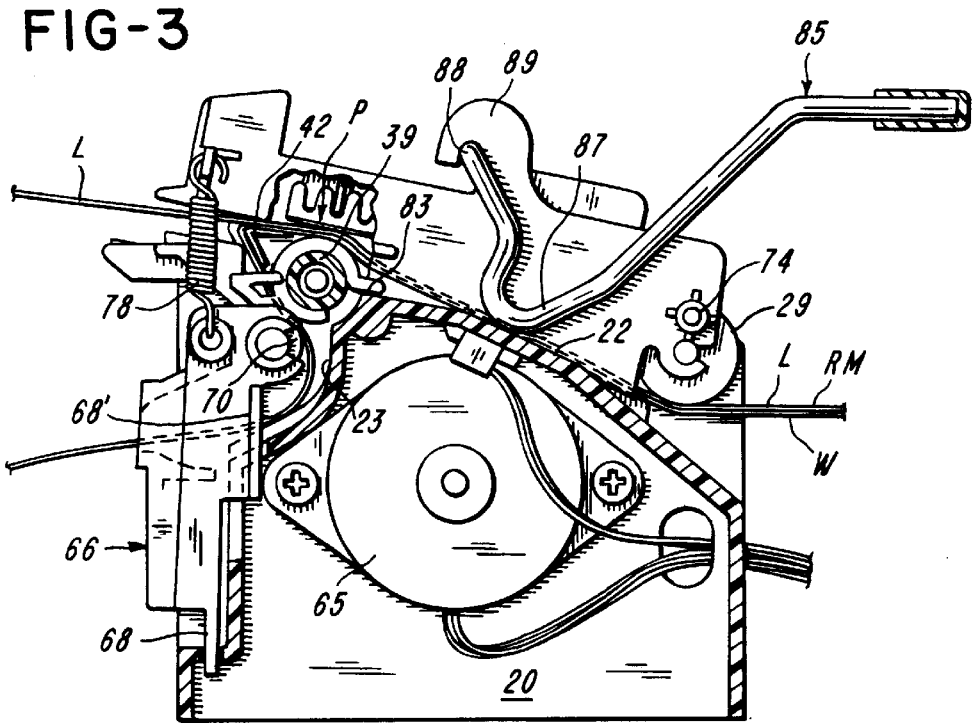
FIG. 3 is a sectional view showing the relationship of operative parts with the print head assembly, the slide and the pressure roller being shown in the operating position.
Figure 4:
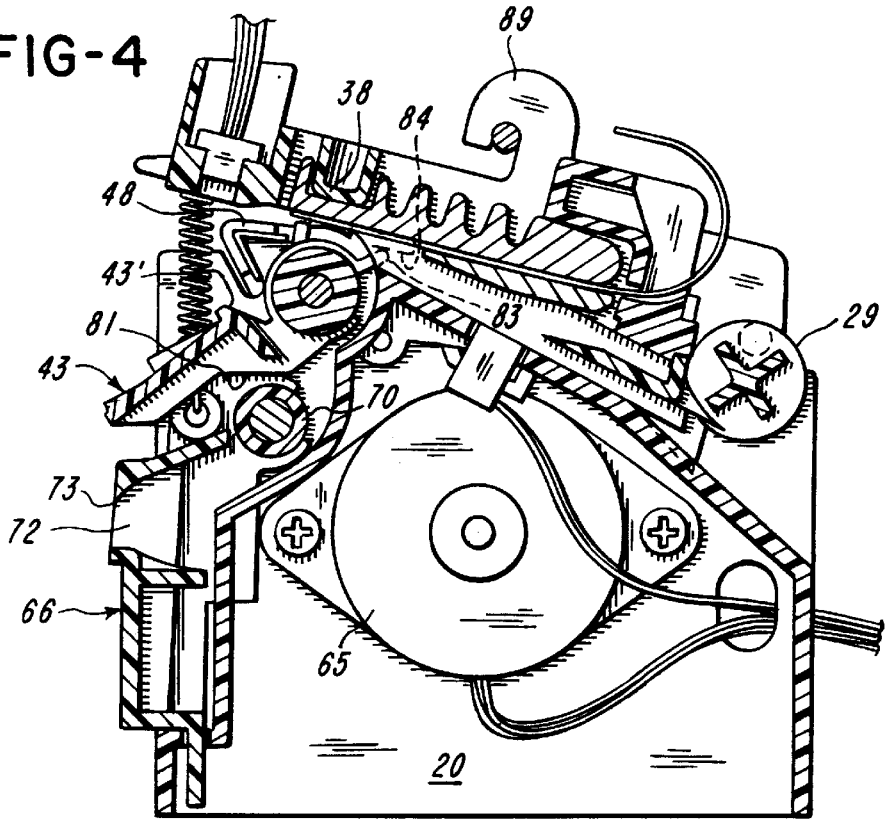
FIG. 4 is a sectional view similar to FIG. 3 but showing the print head assembly in a raised position wherein the print head is separated from the platen roll and wherein the pressure roller is separated from the platen roll.
Figure 5:
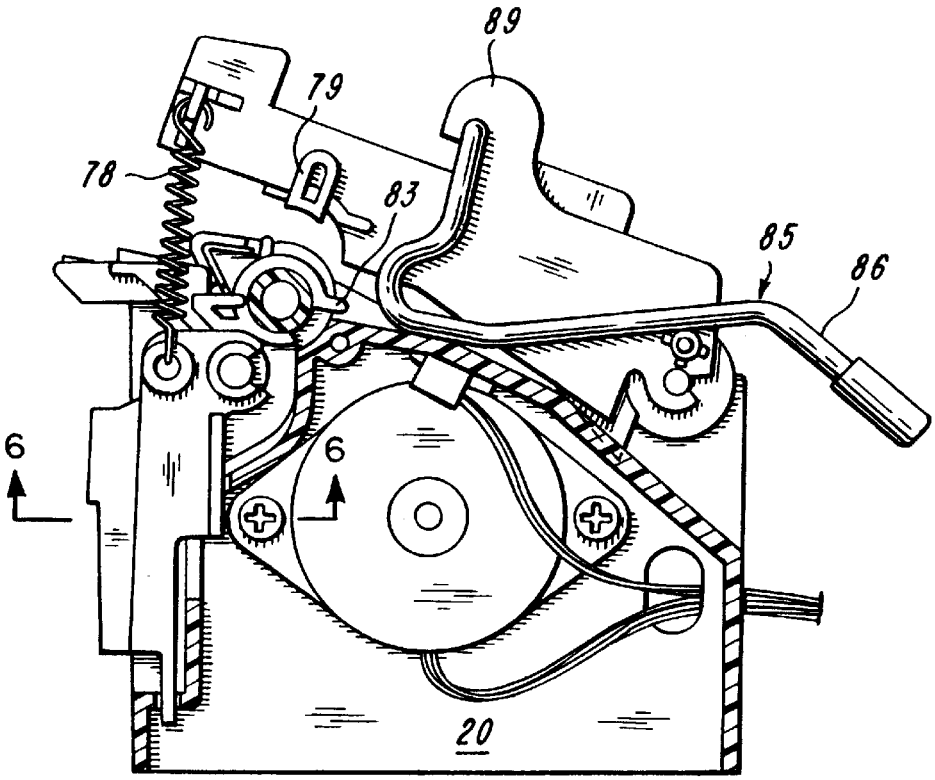
FIG. 5 is a fragmentary partly sectional view in which another device is used to separate the print head assembly widely from the platen roll to facilitate cleaning of the print head and/or the plan-roll.

The delaminator 42 is comprised of a bar which has an acute-angled profile as shown in the drawings. The delaminator 42, thus, provides a peel edge 55 by which a label L (FIG. 3) can be delaminated from the carrier web W. The delaminator 42 fits over acute-angled projections 56 and 57 on end walls 20 and 21. The delaminator 42 is held in place by the angle-shaped wall 48. The captive relationship of the delaminator 42 to the projection 56 and the angle-shaped wall 48 is shown for example in FIG. 4. The lever 43 has generally C-shaped aligned portions 58 received on projections 45. The platen roll 39 is secured to a drive shaft 59 which extends into the projection 45 of the mounting member 41 and extends through the projection 45 in the mounting member 40. A gear 60 is secured to the shaft 59. The gear 62 meshes with a gear 63 secured to an output shaft 64 of an electric stepping motor 65. As shown in FIGS. 3, 4 and 5, the motor 65 is secured to the end wall 20.

Figure 6:
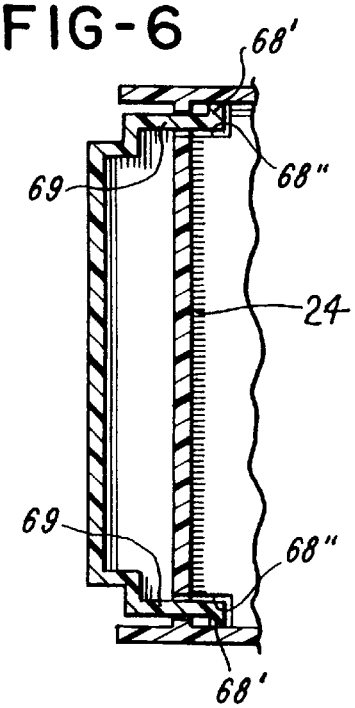
FIG. 6 is a sectional view taken along line 6—6 of FIG. 5 showing the slide retained in the frame.

A slide 66 is mounted for movement at the front wall 24. The front wall terminates at a slot 67 which receives a projection 68 which forms part of the slide 66. The slide 66 has outwardly extending flanges 68' (FIGS. 2 and 6) on walls 69. Flanges 68' are received in slots 68" in the front wall 24. The slide 66 is thus mounted for sliding generally vertical movement at the front wall 24. The slide 66 mounts a pressure roller 70 in C-shaped recesses 71. The slide 66 has an opening 72, the upper edge 73 of which provides a slightly serrated tear edge.

The print had assembly 25 is pivotally mounted to the frame 19 by projections 74 received in slots 75. The holder 26 has hook-shaped ears 76 and the slide 66 has holes 77. Tension springs 78 are connected at their one ends to the ears 76 and at their other ends in holes 77. Thus, the springs 78 simultaneously urge the print head assembly 25 counterclockwise and to urge the slide 66 upwardly as shown for example in FIG. 3. The holder 26 has two downwardly facing projections 79 which are received in converging slots 49' and 50' in end plates 20 and 21. The sides of the cooperating slots 49' and 50' contact the sides of the projections 79 to provide consistent accurate location of the print head assembly 25 with respect to the platen roll 39.

As shown in FIG. 3, the web of record members RM comprises a carrier web W to which a series of labels L are releasably secured. The carrier web W passes over the surface 22 and the labels are printed at a printing position P by the print head 34 cooperating with the driven platen roll 39. The carrier web W passes around the platen roll 39 for a considerable distance and the pressure roll 70 presses the carrier web W against the platen roll 39 as shown. The carrier web W continues to advance while the platen roll 39 is driven and the carrier web W is guided by the wall or surface 23 and exits the opening 72 in the slide 66. The springs 78 urge the slide 66 upwardly and in turn urge the pressure roller 70 into cooperation with the platen roll 39, and, or course, the carrier web W is between and in contact with the pressure roller 70 and the platen roll 39. The lever 43 has a ribbed guide surface 43' which allows only enough clearance for the carrier web W to pass. Therefore, the carrier web W passes between one leg of the delaminator 42 and the guide surface 43'. The delaminator 42 is preferably composed of smooth metal. The cooperation between the guide surface 43", and the delaminator 42 prevents the carrier web W from becoming excessively slack and it also ensures a small peel radius should a slack condition occur.

When it is desired to thread the printer 10 with the web of record members RM, the user depresses the lever 43 with one finger at its finger-engageable portion 80. This causes the springs 78 to be extended as best shown in FIG. 4. The lever has a pair of spaced cam surfaces 81 which bear against surfaces 82 in the slide 66. Therefore, when the lever 43 is depressed against the urging of the springs 78, the slide 66 is cammed downwardly. Accordingly, the pressure roller 70 is moved out of cooperation with the platen roll 39. Substantially simultaneously, projections 83 on C-shaped portions 58 act on pads 84 on the holder 26 to pivot the print head assembly 25 clockwise against the action of springs 78. In this position of the lever 43, the web of record members RM can be threaded through the printer 10 along the label and carrier web pathways shown in FIG. 3 for example. After threading, the lever 43 can be released and the springs 78 pivot the print head assembly counterclockwise and move the slide 66 upwardly.

A device 85 is used to move the print head assembly 25 to a position in which the print head 34 and the platen roll 39 can be readily cleaned, as shown in FIG. 5. The device raises the print head assembly 25, by pivoting it clockwise, without moving the slide 66. Thus, the springs 78 are not stretched excessively. The device 85 (FIGS. 2, 3 and 5) comprise a wire which has been bent to provide an operating handle 86, bearing portions or cam surfaces 87 and a connector portion 88. Normally the device 85 is in the position shown in FIG. 3 with its bearing portions 87 in contact with surfaces 22' outboard the path of the record members RM. The connecting portion passes through two-spaced hook-shaped portions 89 on the holder 26. As the device 85 is pivoted from the position shown in FIG. 3 to the position shown in FIG. 5, the bearing portions 87 slide on surfaces 22' to the position shown in FIG. 5, in which position the device 85 is overcenter and thus is held in the FIG. 5 position. After the print head 34 and the platen roll 39 have been cleaned the device can be returned to the FIG. 3 position by lifting the handle 86. The device 85 can be considered to be an overcenter device.

Other embodiments and modifications of the invention will suggest themselves to those skilled in the art, and all such of these as come within the spirit of this invention are included within its scope as best defined by the appended claims.

We claim:

1. A printer, comprising: a print head, a rotatably mounted platen roll, the print head being selectively positionable at a printing position in printing cooperation with the platen roll to print on labels releasably adhered to a carrier web, at a threading position in which the print head is spaced from the platen roll by a certain distance to enable the carrier web to be threaded between the print head and the platen roll, and at a cleaning position wherein the print head is spaced from the platen roll by a greater distance than the certain distance to enable the print head to be cleaned, a delaminator for delamination labels from the carrier web, and a device for moving the print head from the printing position through the threading position to the cleaning position.

2. A printer as defined in claim 1, wherein the device includes a wire.

3. A printer as defined in claim 1, a frame, wherein the device includes a wire bent to provide an operating handle, bearing portions, and a connector portion joined to the bearing portions, and wherein the bearing portions cooperate with surfaces on the frame.

4. A printer as defined in claim 1, wherein the device includes a bearing portion, and a surface with which the bearing portion cooperates.

5. A printer as defined in claim 1, including springs for urging the print head toward the platen roll to the printing positionl.

6. A printer as defined in claim 1, including a spring for urging the print head toward the platen roll from the cleaning position to the printing position.

7. A printer as defined in claim 1, including a lever for moving the print head from the printing position to the threading position.

8. A printer as defined in claim 1, and finger-engageable portion for moving the print head from the printing position to the threading position.

9. A printer, comprising: a print head, a rotatably mounted platen roll, the print head being selectively positionable at a printing position in printing cooperation with the platen roll to print on labels releasably adhered to a carrier web, at a threading position in which the print head is spaced from the platen roll by a certain distance to enable the carrier web to be threaded between the print head and the platen roll, and at a cleaning position wherein the print head is spaced from the platen roll by a distance greater than the certain distance to enable the print head to be cleaned, a spring with a force for urging the print head to the printing position, delaminator for delamination labels from the carrier web, and a device for moving the print head against the force of the spring from the printing position through the threading position to the cleaning position.

10. A printer as defined in claim 9, including a frame, an electric motor mounted to the frame, gearing connecting the electric motor and the platen roll, and means for rotatably mounting the platen roll to the frame.

11. A printer as defined in claim 9, including a lever for moving the print head from the printing position to the threading position.

12. A printer, comprising: a print head, a rotatably mounted platen roll cooperable with the print head at a printing position, a spring with a force for urging the print head to the printing position, the print head being selectively positionable between a printing position in printing cooperation with the platen roll to print on labels releasably adhered to a carrier web and a cleaning position at which the print head can be cleaned, a delaminiator for delaminating labels from the carrier web, and a device for moving the print head against the force of the spring from the printing position to the cleaning position.

13. A printer, comprising: a print head, a rotatably mounted platen roll, the print head being selectively positionable at a printing position in printing cooperation with the platen roll to print on labels releasably adhered to a carrier web, at a threading position in which the print head is spaced from the platen roll by a certain distance to enable the carrier web to be threaded between the print head and the platen roll, and at a cleaning position, wherein the print head is spaced from the platen roll by a greater distance than the certain distance to enable the print head to be cleaned, a delaminator for delaminating labels from the carrier web, a pivotally mounted device including a manually movable handle for moving the print head to the cleaning position.

14. A printer, comprising: a print head, a rotatably mounted platen roll, the print head being selectively positionable at a printing position in printing cooperation with the platen roll to print on labels releasably adhered to a carrier web, at a threading position in which the print head is spaced from the platen roll by a certain distance to enable the carrier web to be threaded between the print head and the platen roll, and at a cleaning position wherein the print head is spaced from the platen roll by a distance greater than the certain distance to enable the print head to be cleaned, a spring for urging the print head to the printing position, a delaminator for delaminating labels from the carrier web, a pivotally miotunted device including a manually movable handle for moving the print head to the cleaning position.

15. A printer, comprising: a thermal print head, a platen roll cooperable with the print head at a printing position to print on labels releasably adhered to a carrier web, a delaminator for delaminating printed labels from the carrier web, a pressure roller cooperable with the carrier web and the platen roll downstream of printing position, a manually movable lever for substantially simultaneously moving the print head and the pressure roller away from the platen roll.

16. A printer as defined in claim 15, including spring means for urging the print head and the pressure roller toward the platen roll.

17. A printer, comprising: a print head, a rotatably mounted platen roll, the print head being selectively positionable at a printing position in printing cooperation with the platen roll to print on labels releasably adhered to a carrier web, at a threading position in which the print head is spaced from the platen roll by a certain distance to enable the carrier web to be threaded between the print head and the platen roll, and at a cleaning position wherein the print head is spaced from the platen roll by a greater distance than the certain distance to enable the print head to be cleaned, a delaminator for delaminating labels from the carrier web, at least one bearing portion, a surface against which said at least one bearing portion bears, and a handle for moving the bearing portion relative to the surface to move the print head from the printing position through the threading position to the cleaning position.

18. A printer, comprising: a print head, a rotatably mounted platen roll, the print head being selectively positionable at a printing position in printing cooperation with the platen roll to print on labels releasably adhered to a carrier web, at a threading position in which the print head is spaced from the platen roll by a certain distance to enable the carrier web to be threaded between the print head and the platen roll, and at a cleaning position wherein the print head is spaced from the platen roll by a greater distance than the certain distance to enable the print head to be cleaned, a delaminator for delaminating labels from the carrier web, and an overcenter device for moving the print head from the printing position through the threading position to the cleaning position.

19. A printer, comprising: a print head, a rotatably mounted platen roll, the print head being selectively positionable at a printing position in printing cooperation with the platen roll to print on labels releasably adhered to a carrier web, at a threading position in which the print head is spaced from the platen roll by a certain distance to enable the carrier web to be threaded between the print-head and the platen roll, and at a cleaning position wherein the print head is spaced from the platen roll by a greater distance than the certain distance to enable the print head to be cleaned, a delaminator for delaminating labels from the carrier web, at least one bearing portion, a surface against which the at least one bearing portion bears, the bearing portion being movable relative to the surface to move the print head from the printing position through the threading position to the cleaning position.

20. A printer, comprising: a print head, a rotatably mounted platen roll, the print head being selectively positionable at a printing position in printing cooperation with the platen roll to print on labels releasably adhered to a carrier web, at a threading position in which the print head is spaced from the platen roll by a certain distance to enable the carrier web to be threaded between the print head and the platen roll, and at a cleaning position wherein the print head is spaced from the platen roll by a greater distance than the certain distance to enable the print head to be cleaned, a delaminator for delaminating labels from the carrier web, at least one cam surface, a bearing surface against which the at least one cam surface bears, and a handle for moving the cam surface relative to the bearing surface to move the print head from the printing position through the at least one threading position to the cleaning position.

* * * * *

UNITED STATES PATENT AND TRADEMARK OFFICE

CERTIFICATE OF CORRECTION

PATENT NO. : 5,892,531

DATED : April 6, 1999

INVENTOR(S) : John D. Mistyurik et al

It is certified that error appears in the above-indentified patent and that said Letters Patent is hereby corrected as shown below:

Title Page, References Cited, 4,776,714, "Sugihara et al" should be --Sugiura et al--. Column 2, line 6, "plan-roll" should be --platen roll--. Column 4, line 44, "delamination" should be --delaminating--; line 59, "positionl" should be --position--. Column 5, line 12, "delamination" should be --delaminating--; line 30, "delaminator" has been misspelled; line 59, "mounted" has been misspelled. Column 6, line 63, after "the" (first occurrence) --at least one-- has been omitted; line 64, "at least one" should be omitted. Column 3, line 20, "had" should be --head--.

Signed and Sealed this
First Day of February, 2000

*Attest:*

Q. TODD DICKINSON

*Attesting Officer*

*Acting Commissioner of Patents and Trademarks*